US010138841B2

(12) United States Patent
Reinhart et al.

(10) Patent No.: US 10,138,841 B2
(45) Date of Patent: Nov. 27, 2018

(54) CAM COVER ASSEMBLY CAP PLUG FOR FLEXIBLE USE OF CYLINDER HEAD ACCESSORY DRIVE

(71) Applicant: Ford Global Technologies, LLC, Dearborn, MI (US)

(72) Inventors: Paul Thomas Reinhart, Livonia, MI (US); Chad Michael Strimpel, Maybee, MI (US); Joan Prater-Hebeeb, Monroe, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 64 days.

(21) Appl. No.: 15/290,761

(22) Filed: Oct. 11, 2016

(65) Prior Publication Data

US 2018/0100467 A1 Apr. 12, 2018

(51) Int. Cl.
*F02F 11/00* (2006.01)
*F02F 1/24* (2006.01)

(52) U.S. Cl.
CPC ..... *F02F 11/002* (2013.01); *F02F 1/24* (2013.01)

(58) Field of Classification Search
CPC ..... F01L 2001/0476; F01L 1/08; F02F 7/006; F02F 11/002; F01M 2011/0054
See application file for complete search history.

(56) References Cited

U.S. PATENT DOCUMENTS 4,227,705 A 10/1980 Kuramoto
4,396,200 A 8/1983 Ukai et al.
4,777,842 A * 10/1988 Yamada ..... F01L 1/0532 123/90.27
6,223,709 B1 * 5/2001 Takahashi ..... F01L 1/0532 123/193.5
6,805,083 B2 10/2004 Kaczmarek et al.
8,181,614 B2 * 5/2012 Sugiura ..... F01L 1/053 123/90.16
8,231,278 B1 * 7/2012 Carruth ..... F16C 17/022 123/195 R
8,418,670 B2 * 4/2013 Abe ..... F01L 1/04 123/195 A
9,038,614 B2 5/2015 Valencia
2002/0166534 A1 * 11/2002 Schneider ..... F01L 1/02 123/195 C (Continued)

FOREIGN PATENT DOCUMENTS

JP 2010249270 A 11/2010

*Primary Examiner* — Long T Tran
(74) *Attorney, Agent, or Firm* — LeClairRyan

(57) ABSTRACT

A cam cover cap plug for use with a cylinder head assembly to fill the opening that remains when an accessory unit such as a READ utility pump is not utilized. The cam cover cap plug is preferably a one-piece, molded component formed from a plastic or a metal. The cam cover cap plug includes a back, a front, an upper surface and a lower surface. The upper surface is arched and defines a half-round configuration. The lower surface is flat and includes integrated cylinder head fasteners extending from the flat surface. The arched, half-round configuration of the upper surface provides a full and complete sealing area with the half-round opening of the cam cover formed to receive the accessory unit. The fasteners of the lower surface are preferably integrated dowels. The integrated dowels locate the cam cover cap plug base to the cylinder head of the cylinder head assembly.

18 Claims, 12 Drawing Sheets

(56) References Cited

U.S. PATENT DOCUMENTS

| | | | | |
|---|---|---|---|---|
| 2009/0145387 | A1* | 6/2009 | Takane | F01L 1/0532 123/90.33 |
| 2012/0313331 | A1 | 12/2012 | Yamamoto | |
| 2015/0159524 | A1* | 6/2015 | Kawakami | F01L 1/46 123/90.37 |
| 2015/0377088 | A1* | 12/2015 | Fujiwara | F01L 1/46 123/90.1 |
| 2016/0177867 | A1 | 6/2016 | Wicks et al. | |

* cited by examiner

CAM COVER ASSEMBLY CAP PLUG FOR FLEXIBLE USE OF CYLINDER HEAD ACCESSORY DRIVE

TECHNICAL FIELD

The disclosed inventive concept relates generally to components for the internal combustion engine of a vehicle. More particularly, the disclosed inventive concept relates to the cam cover assembly cap plug for use in place of an accessory unit such as a Rear End Accessory Drive (READ) when such a unit is absent from the engine to fill and seal the area at the rear of the cylinder head and cam cover.

BACKGROUND OF THE INVENTION

In addition to being available in many displacements, the modern internal combustion engine is capable of being provided by the manufacturer in many variations to suit the preferences of the driver and to meet certain anticipated driving demands. The vehicle buyer can choose from an increasingly broad array of vehicle options, many of which including drive units or power takeoffs that are directly attached to the engine itself. In addition, the manufacturer may elect to include or not include one or more units based on vehicle configuration.

For example, the engine may be equipped with Rear End Accessory Drive (READ) unit driven by a camshaft. It is possible to have more than one READ unit in the event that the engine has more than one camshaft. These units are selected from coolant, fuel, and vacuum pumps which provide complex component and system assembly packages. When the cylinder head assembly is equipped with one or more such units, components of the assembly are machined and assembled as required to provide for proper and full functioning of the accessory unit.

In the event that one or more units is not included in the engine assembly, a block off plate is fitted in place of the portion of the accessory unit that attaches to the cylinder head assembly. While appearing to be a practical solution to the absence of an accessory unit, the use of the block off plate has certain known challenges that include increased component costs, increased assembly costs, increased leak paths, increased overall engine weight, and the need for additional packaging space.

More particularly, when a block off plate is used in place of the accessory unit, cylinder head and cam cover sealing becomes quite complex due to having to seal the pump area at the rear of the cylinder head. Known assembly requires updates to the cylinder head, the cam cover, additional sealing cam caps, press-in place (PIP) seals, room temperature vulcanizing (such as RTV sealant) and anaerobic sealant to seal the joint(s) properly. Unique cylinder head assemblies and/or cam cover(s) assemblies are required to contain complexity driving additional investment and processing.

Thus a new approach to sealing an internal combustion engine in the event that an accessory unit is elected against is needed to address the problems associated with known arrangements.

SUMMARY OF THE INVENTION

The disclosed inventive concept overcomes the challenges faced by known arrangements for sealing the cylinder head assembly of an internal combustion engine by providing a cam cover plug that provides an accurate and complete seal for the cylinder head assembly in the event that no accessory unit is provided to the end of the camshaft. The cam cover cap plug of the disclosed inventive concept fills and seals the area at the rear of the cylinder head and cam cover when an accessory unit such as a READ utility pump is not being utilized.

The cam cover cap plug of the disclosed inventive concept is preferably a one-piece, molded component formed from a plastic or a metal. The cam cover cap plug includes a back, a front, an upper surface and a lower surface. The upper surface is arched and defines a half-round configuration. The lower surface is flat and includes integrated cylinder head fasteners that extend from the flat surface. The integrated fasteners are preferably molded with the body of the cam cover cap plug, thus avoiding an assembly step.

The arched, half-round configuration of the upper surface is configured to provide a full and complete sealing area with the half-round opening of the cam cover formed to receive the accessory unit. The fasteners of the lower surface are preferably integrated dowels of the split or non-split type. The integrated dowels locate the cam cover cap plug base to the cylinder head of the cylinder head assembly.

Implementation of the cam cover cap plug according to the disclosed inventive concept allows for use of a common cylinder head casting and/or partial common machining of the cylinder heads and/or use of a common cam cover housing. The cam cover cap plug of the disclosed inventive concept can seal the half-round opening in the cam cover when an accessory unit such as a READ utility pump is not being utilized.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
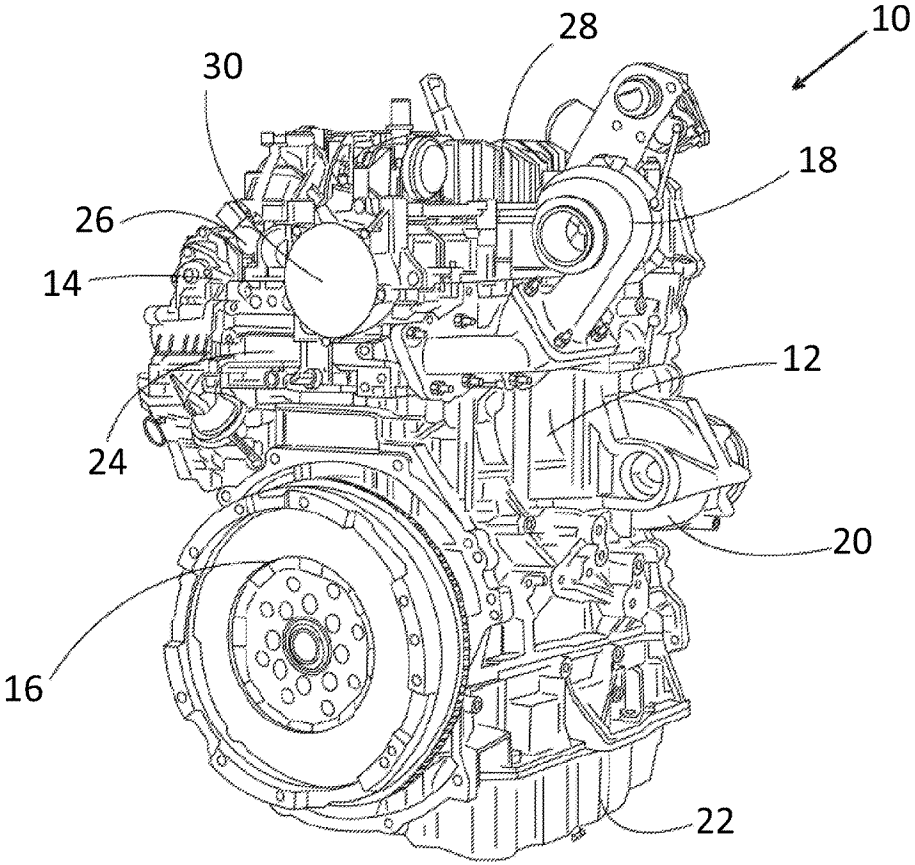
FIG. 1 PRIOR ART
FIG. 1 is a perspective view of a vehicle engine having a utility pump in position on the cylinder head assembly viewed from the rear of the engine according to known technology.

In the following figures, the same reference numerals will be used to refer to the same components. In the following description, various operating parameters and components are described for different constructed embodiments. These specific parameters and components are included as examples and are not meant to be limiting.

The accompanying figures show both the state of the art of cylinder block assemblies and the current approach to providing a block-off plate for use when an accessory utility pump is not utilized. The accompanying figures also show two variations of the disclosed solution to difficulties encountered in the prior art. It is to be understood that the disclosed variations are suggestive only as other variations may be possible.

A typical internal combustion engine for an automotive vehicle having an attached utility pump is illustrated in FIG. 1. The engine, generally illustrated as 10, is viewed from the rear. The engine 10 includes a cylinder block 12 and a cylinder head assembly 14. As is understood according to known art, the cylinder block 12 includes a flywheel 16 connected to the engine's crankshaft (not shown). An air intake system 18 such as the illustrated turbocharger is fixed to the intake ports (not shown) formed in the cylinder block 12. An exhaust after-treatment assembly 20 is fixed to the exhaust ports (not shown) formed in the cylinder block 12. An oil pan 22 is attached to the underside of the cylinder block 12.

The cylinder head assembly 14 includes a cylinder head 24 to which a fuel intake assembly, such as the illustrated fuel injection system 26, is attached. A cylinder head/cam cover 28 is attached to the upper surface of the cylinder head 24. The cam cover 28 encloses one or more camshafts and the upper portions of the valve assemblies as is understood in the art.

It is typical in today's vehicle to have one or more accessory drive units attached to the cylinder head assembly 14. As shown in FIG. 1, a utility pump 30 is attached to the rear end of the cylinder head assembly 14 and is driven by a camshaft. The illustrated utility pump 30 is a vacuum pump. Attachment of the utility pump 30 to the engine requires necessary machining and assembly both the cylinder head 24 and the cam cover 28.

Figure 2:
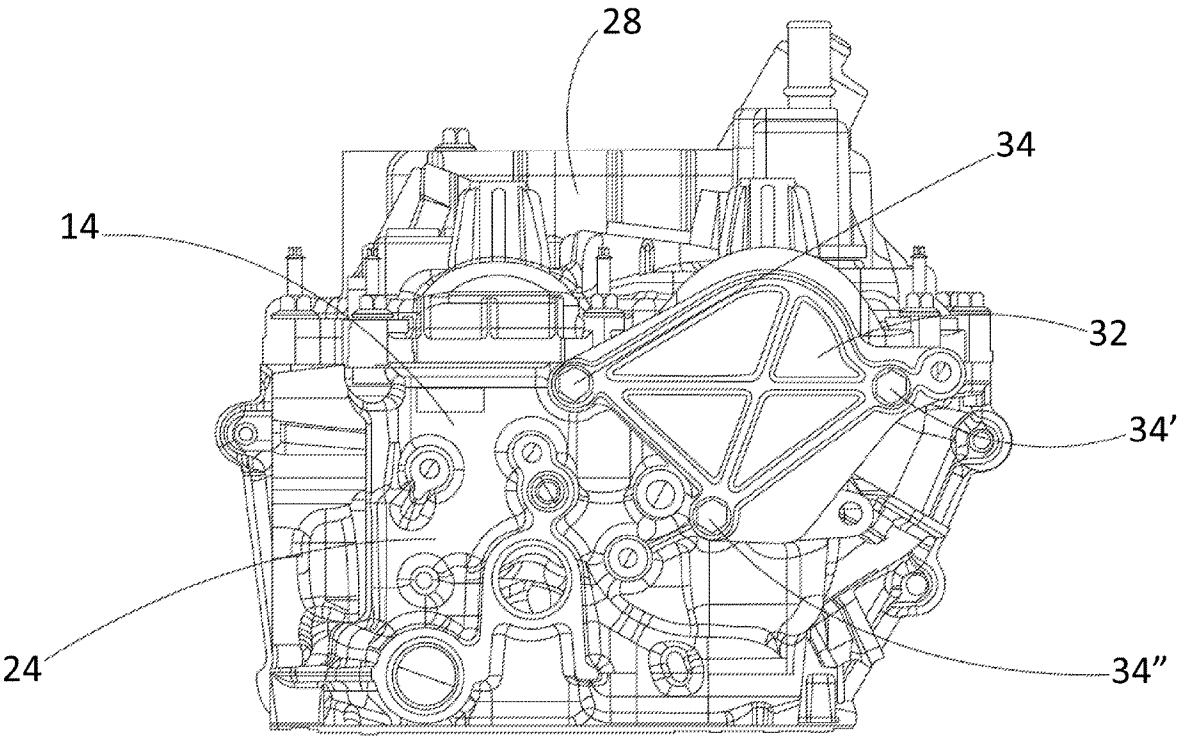
FIG. 2 PRIOR ART
FIG. 2 is a rear view of a cylinder head assembly illustrating a known block-off plate in position on the cylinder head assembly when the utility pump is not utilized.

In the event that no utility pump is attached to the engine 10, it is necessary at the manufacturing stage to attach to the front of the cylinder head assembly 14 a plate to restrict the passage of oil from the cylinder head assembly 14 and to prevent the introduction of dirt and other contaminants into the cylinder head assembly 14. Such an arrangement is illustrated in FIG. 2 in which no utility pump is attached to the cylinder head assembly. In lieu of the utility pump, a block-off plate 32 is attached to the rear of the cylinder assembly. Attachment of the block-off plate 32 is conventionally made by fasteners such as bolts 34, 34' and 34". As previously noted, the known block-off plate 32 is prone to leakage while adding weight and requiring added packaging space. The known block-off plate 32 thus results generally in added expense and size while reducing reliability.

The cam cover cap plug of the disclosed inventive concept provides a practical and effective seal at a low cost when no utility pump is selected. The cam cover cap plug is illustrated in position in a cylinder head assembly in FIGS. 3 through 6 and is shown in isolation in FIGS. 7 through 12. In general, the cam cover plug of the disclosed inventive concept is a one-piece molded component that is formed from a polymerized material such as a reinforced or composite plastic or from a metal such as aluminum.

Figure 3:
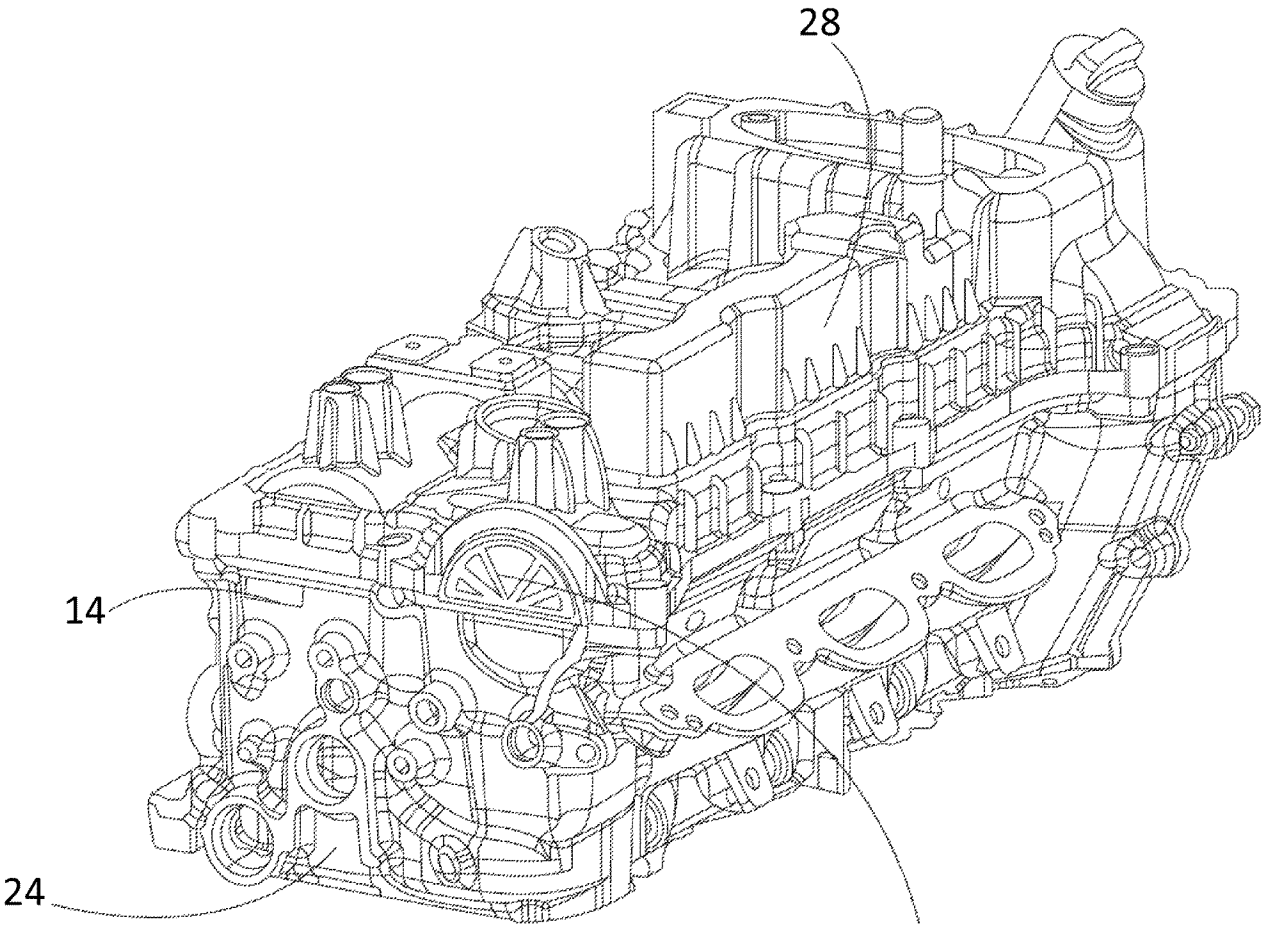
FIG. 3 is a rear view of a cylinder head assembly in which a first embodiment of a cam cover cap plug according to the disclosed inventive concept is in position when the utility pump is not utilized.

Referring to FIGS. 3 through 6, a cam cover cap plug 50 is shown in position in the rear of the cylinder head assembly 14. As shown in FIG. 3, the cam cover cap plug 50 is fitted between the cylinder head 24 and the cam cover 28. On assembly, the cam cover cap plug 50 is first attached to a upper machined surface of the 51 cylinder head 24. Once secured in position, the cam cover 28 is fitted to the cylinder head 24. The cam cover cap plug 50 is thus securely locked between the cylinder head 24 and the cam cover 28, thereby providing a fluid-tight seal.

Figure 4:
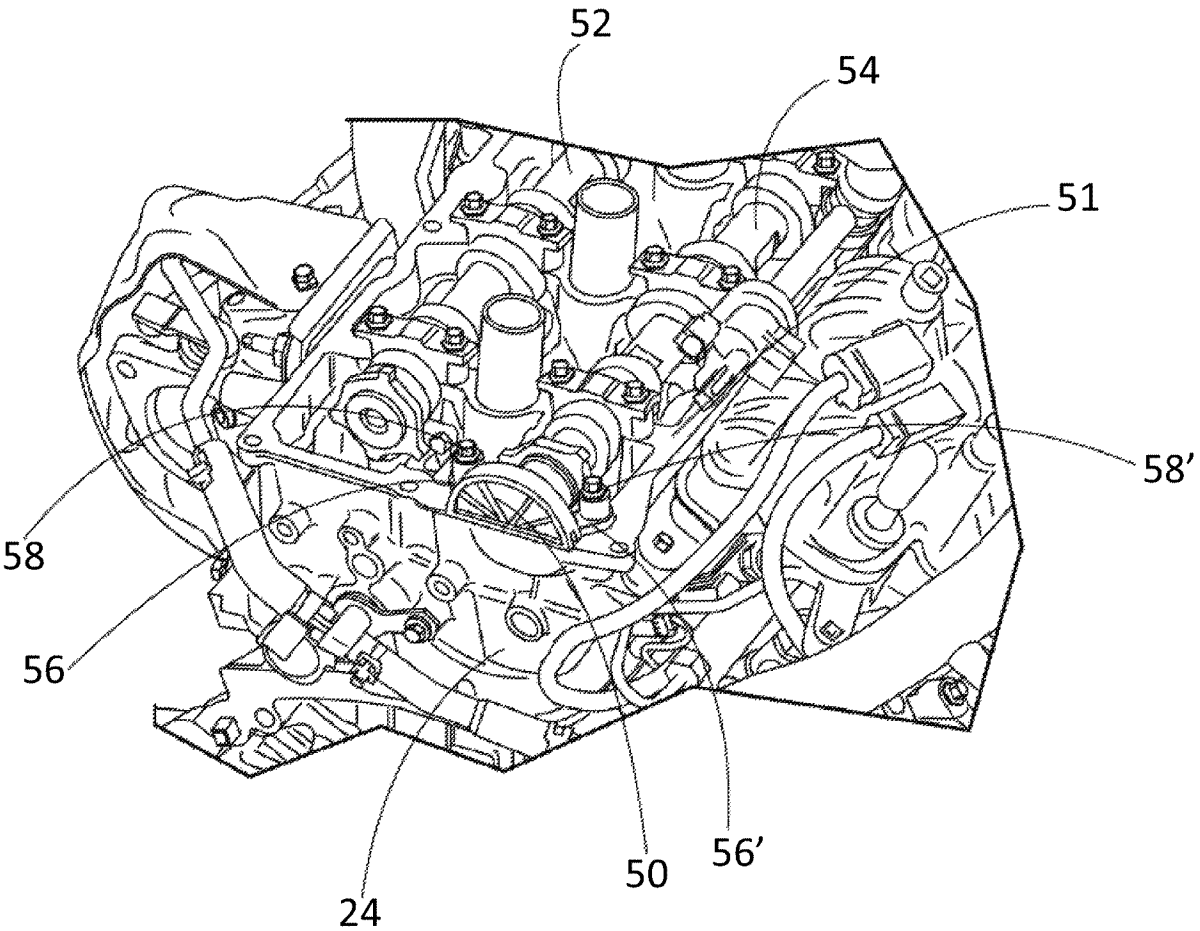
FIG. 4 is a perspective view of one side of a cylinder head without the cam cover in which the cam cover cap plug of FIG. 3 according to the disclosed inventive concept is in position when viewed from one angle.
Figure 5:
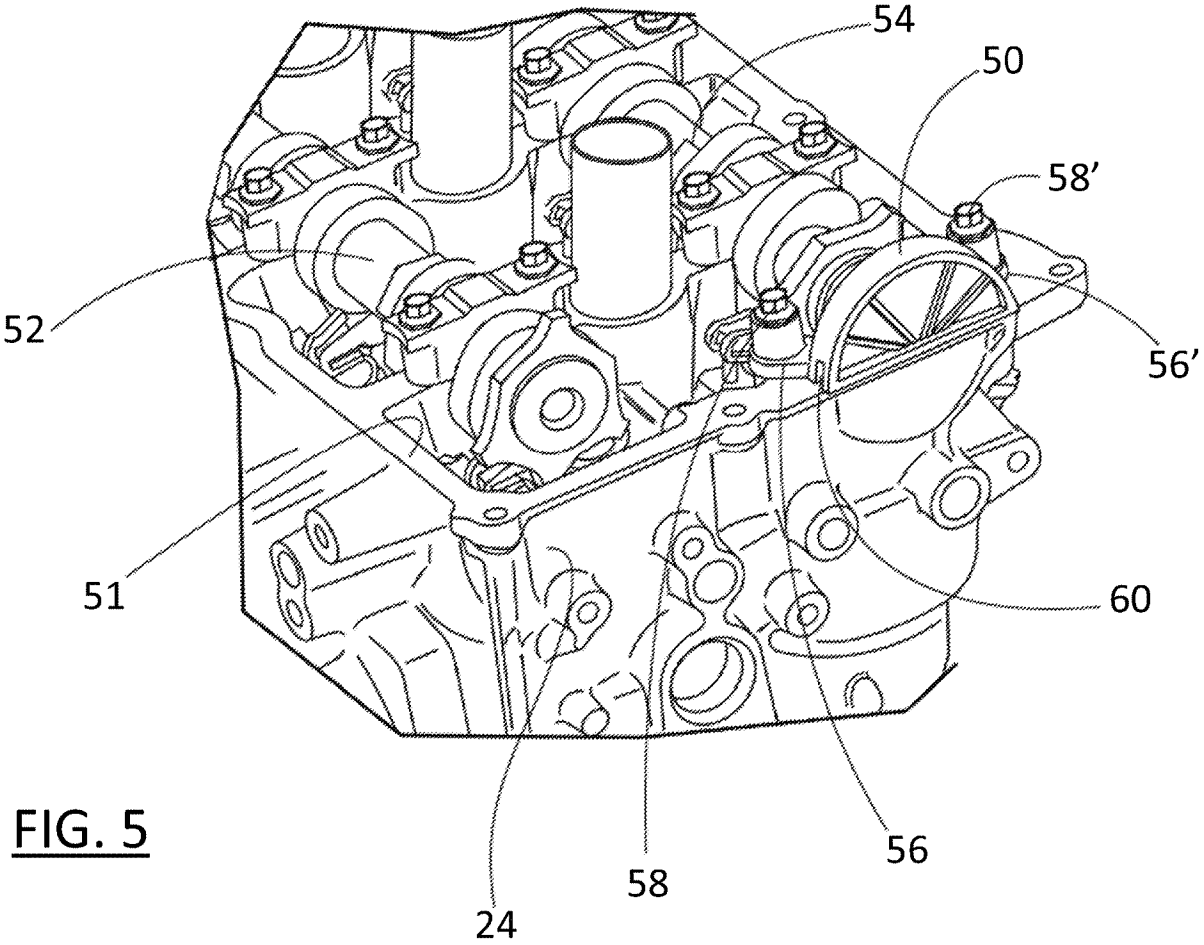
FIG. 5 is a perspective view of one side of a cylinder head without the cam cover in which the cam cover cap plug of FIG. 3 according to the disclosed inventive concept is in position when viewed from another angle.
Figure 6:
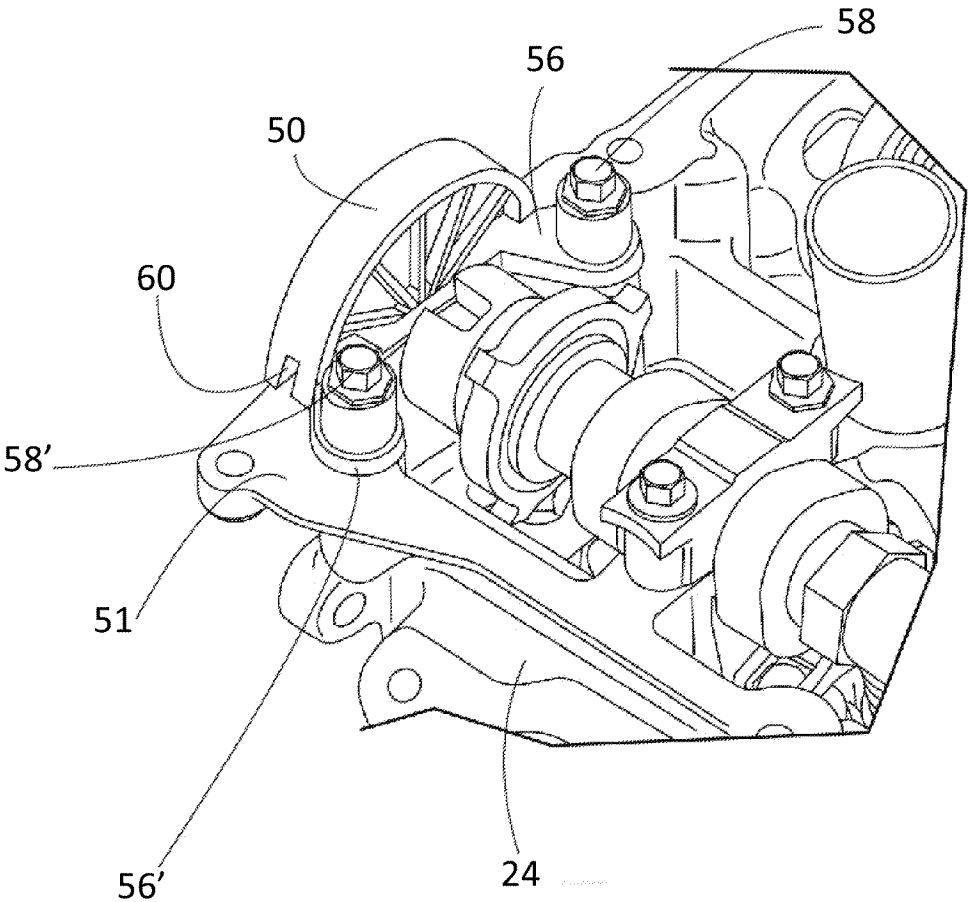
FIG. 6 is a perspective view of one side of a cylinder head without the cam cover in which the cam cover cap plug of FIG. 3 according to the disclosed inventive concept is in position viewing the back side of the cam cover cap plug.
Figure 7:
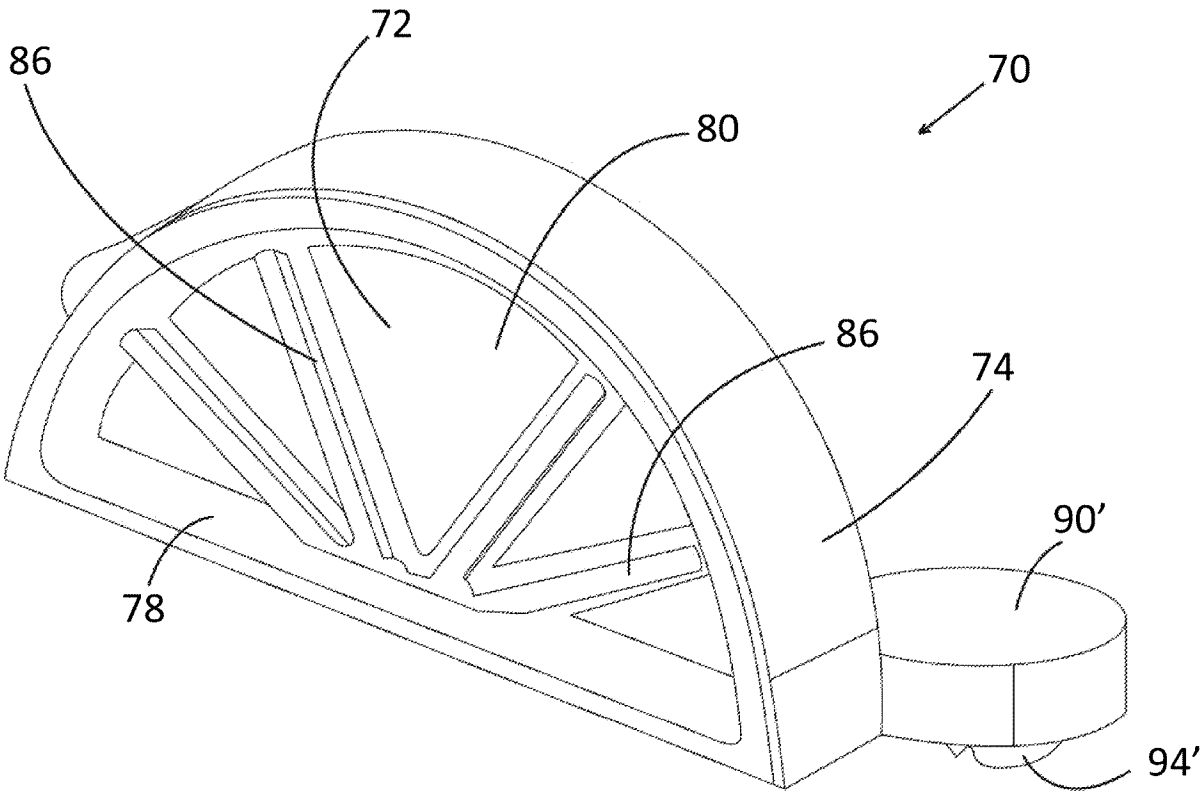
FIG. 7 is a perspective view of the first alternative embodiment of the cam cover cap plug according to the disclosed inventive concept when viewed generally from the front.
Figure 8:
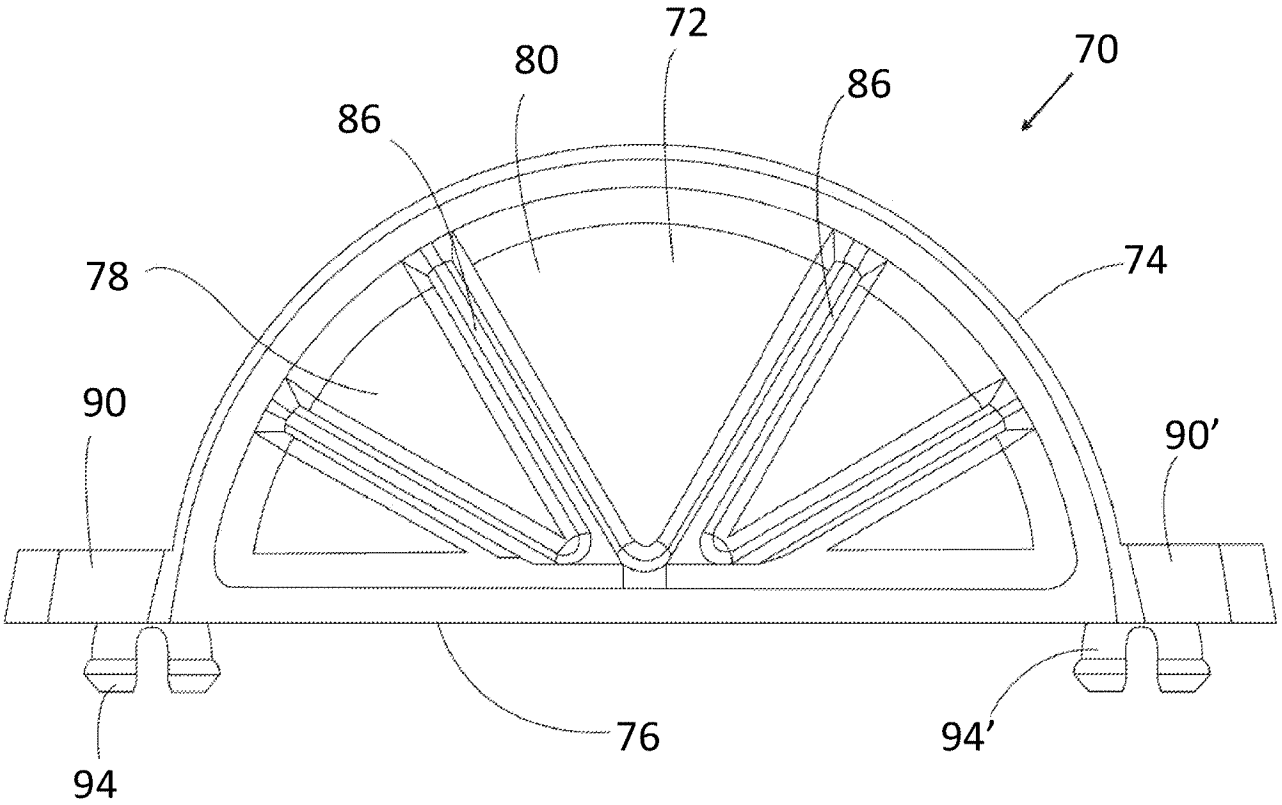
FIG. 8 is a front view of the first alternative embodiment of the cam cover cap plug.
Figure 9:
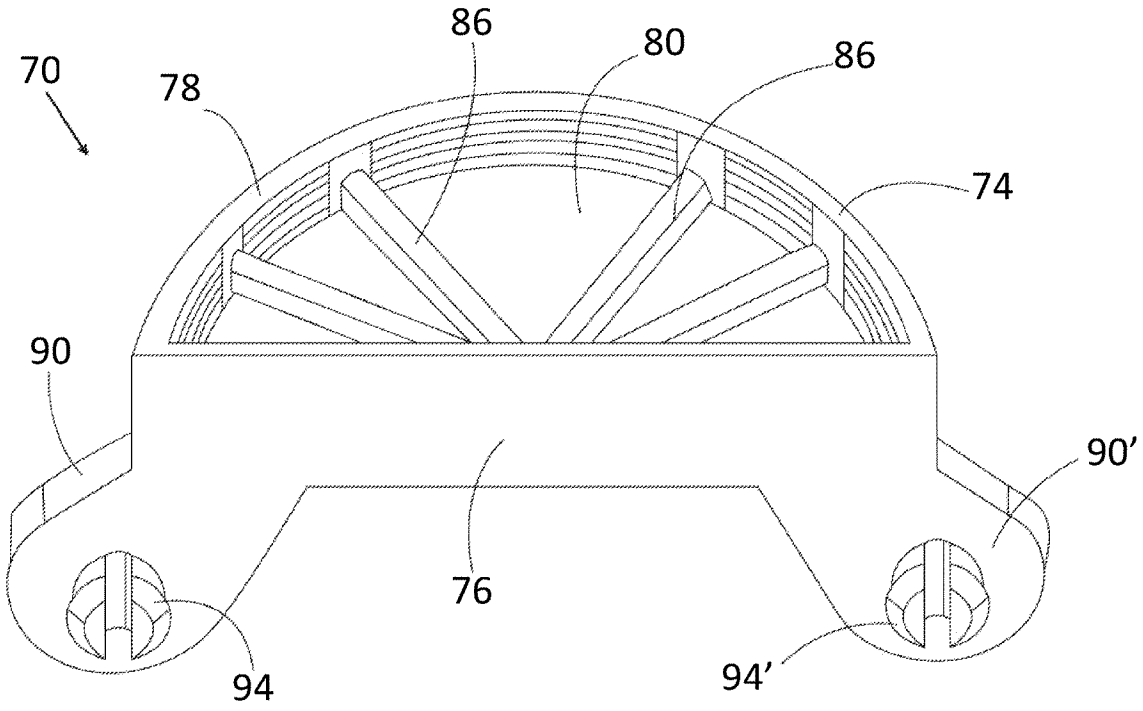
FIG. 9 is an underside view of the first alternative embodiment of the cam cover cap plug.

The cam cover cap plug 50 is illustrated attached to the cylinder head 24 in FIGS. 4 through 6 without the cam cover 28. As is known, at least one camshaft is installed in the cylinder head 24 and, more commonly, an intake camshaft 52 and an exhaust camshaft 54 are provided. In this instance, the cam cover cap plug 50 is provided to cover the opening in the cam cover 28 formed at one end of the exhaust camshaft 54.

The cam cover cap plug 50 is attached to the upper machined surface 51 of the cylinder head 24. Attachment may be made by dowels, by mechanical fasteners, or by a combination of the two arrangements. The mechanical fasteners are utilized when a gasket is utilized between the cam cover cap plug 50 and the cylinder head 24. Alternatively, dowels may be used by themselves to locate the cam cover cap lug while utilizing a sealant to seal with the cylinder head 24.

The cam cover cap plug 50 illustrated in FIGS. 4 through 6 is attached by way of mechanical fasteners. Mechanical fastening is made possible by the provision of a pair of spaced apart and opposed attachment arms 56 and 56' that are integrally formed with the cam cover cap plug 50. Once the cam cover cap plug 50 is in its preferred position on the upper machined surface 51, a pair of mechanical fasteners such as bolts 58 and 58' are used to secure the cam cover cap plug 50 to the upper machined surface 51 of the cylinder head 24. For additional leak-protection, an elongated groove 60 may be formed for a gasket or other seal in the underside of the cam cover cap plug 50.

One embodiment of the cam cover cap plug according to the disclosed inventive concept is illustrated in FIGS. 3 through 6 and has been discussed in conjunction therewith. Two variations of the cam cover cap plug according to the disclosed inventive concept are illustrated in FIGS. 7 through 12 and are discussion in relation to these figures. It is to be understood that additional variations of the cam cover cap plug may be envisioned without deviating from the spirit or scope of the disclosed inventive concept.

Referring to FIGS. 7 through 10, various views of a first alternative embodiment of the cam cover cap plug of the disclosed inventive concept are shown. In these figures, a cam cover cap plug, generally illustrated as 70, is shown. The cam cover cap plug 70 defines a half-round configuration that includes a body 72 having an arched top 74 and a flat underside 76. The arched top 74 provides effective sealing to the cam cover while the flat underside 76 allows for proper sealing to the cylinder head.

The cam cover cap plug 70 further includes a front 78 optionally including a recessed area 80 and a back 82 optionally including a recessed area 84. A plurality of reinforcing ribs 86 may be formed in the recessed area 80 of the front 78. A plurality of reinforcing ribs 88 may be formed in the recessed area 84 of the back 82.

Figure 10:
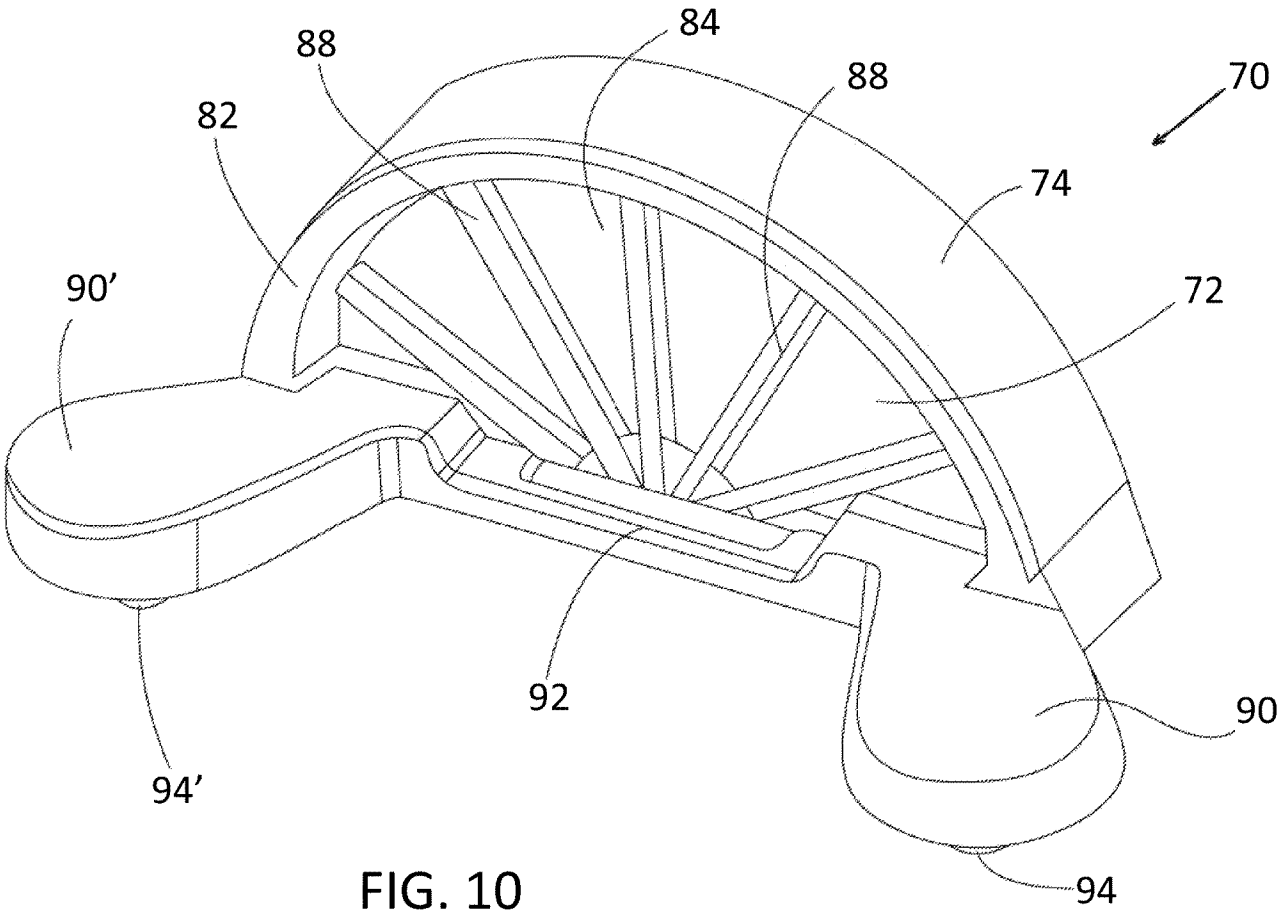
FIG. 10 is a perspective view of the first alternative embodiment of the cam cover cap plug according to the disclosed inventive concept when viewed generally from the back.

Extending away from the back 82 of the body 72 is a pair of spaced apart arms 90 and 90'. As shown in FIG. 10, a narrow bridge 92 may be formed along the back 82 of the body 72 to connect the arms 90 and 90', thereby increasing the structural integrity of the cam cover cap plug 70 while also providing additional surface area to the flat underside 74, the area of the cam cover cam plug 70 that would naturally be most susceptible to oil leakage.

As noted above with respect to FIGS. 3 through 6, attachment of the cam cover cap plug of the disclosed inventive concept to the upper machined surface of the cylinder head may be made by use of mechanical fasteners. As an alternative, locating plugs or dowels may be used for attachment. The embodiments of FIGS. 7 through 12 illustrate such a construction.

Still referring to FIGS. 7 through 10, a pair of spaced apart dowels 94 and 94' is provided on the underside of the cam cover cap plug 70. The dowels 94 and 94' are of the split type. The dowel 94 extends from the underside of the arm 90 while the dowel 94' extends from the underside of the arm 90'. The dowels 94 and 94' are preferably integrally molded with the cam cover plug 70, thus avoiding the need for additional fasteners and reducing both manufacturing and installation time.

Figure 11:
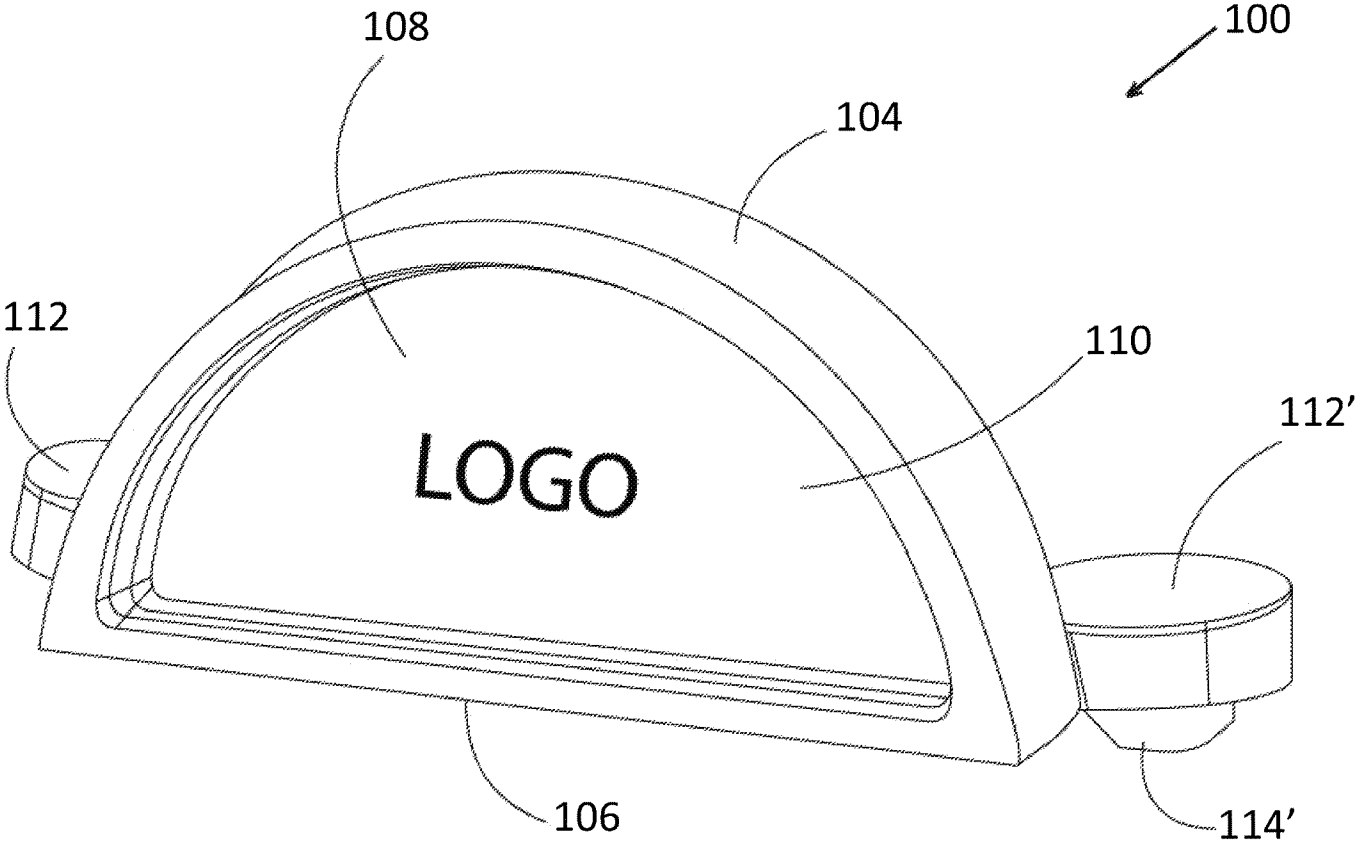
FIG. 11 is a perspective view of the second alternative embodiment of the cam cover cap plug according to the disclosed inventive concept when viewed generally from the front.
Figure 12:
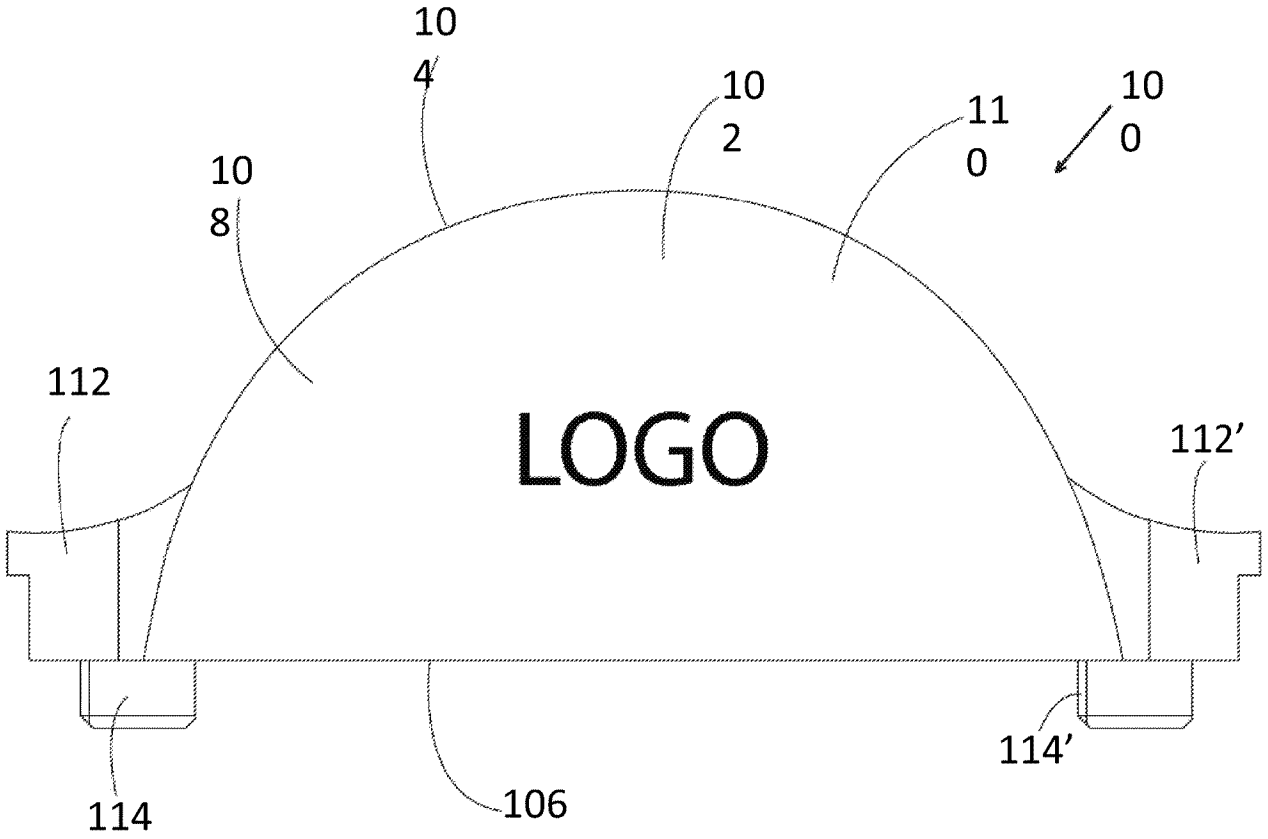
FIG. 12 is a front view of the second alternative embodiment of the cam cover cap plug.

Referring to FIGS. 11 and 12, perspective and front views of a second alternative embodiment of the cam cover cap plug of the disclosed inventive concept are illustrated. In these figures, a cam cover cap plug, generally illustrated as 100, is shown. The cam cover cap plug 100 also defines a half-round configuration that includes a body 102 having an arched top 104 and a flat underside 106.

The cam cover cap plug 100 further includes a front 108 that optionally includes an area 110 reserved for inclusion of an appropriate logo representing, for example, the brand of the manufacturer Extending away from the back of the body 102 of the cam cover cap plug 100 is a pair of spaced apart arms 112 and 112'. Extending from each of the arms 112 and 112' is a dowel of the traditional, non-split variety. Particularly, a non-split dowel 114 extends from the underside of the arm 112 while a non-split dowel 114' extends from the underside of the arm 112'.

Regardless of the embodiment, the cam cover cap plug of the disclosed inventive concept as set forth herein allows for multiple assembly options while minimizing assembly and sealing complexity. The cam cover cap plug may be mechanically attached to the cylinder head as noted above in the discussion regarding FIGS. 3 through 6 or may utilize dowels to locate the plug to the cylinder head, followed by the provision of a sealant. If the latter route is selected, the sealant may be of the aerobic or anaerobic variety. Such sealants may include heat- and oil-resistant sealants such as RTV. When a cam cover cap plug having dowels is used, the load from the cam cover fasteners provides initial clamp load during assembly of the cam cover cap plug and the sealant. When implementing the cam cover cap plug according to the disclosed inventive concept, the traditional READ sealing cover is eliminated, including required fasteners, thus preventing leakage along and potential leak paths.

One skilled in the art will readily recognize from such discussion, and from the accompanying drawings and claims that various changes, modifications and variations can be made therein without departing from the true spirit and fair scope of the invention as defined by the following claims.

What is claimed is:

1. A cam cover assembly cap plug comprising:
- a body having a front, a back, an arched top, and an underside;
- a pair of spaced apart arms extending from said back of said body, said arms being connected by a reinforcing bridge; and
- a fastener extending from each of said arms,
- wherein at least one of said front and said back includes a recessed area.

2. The cam cover assembly of claim 1, wherein said underside is flat and includes a seal-receiving groove.

3. The cam cover assembly of claim 1, wherein said fastener is a dowel.

4. The cam cover assembly of claim 3, wherein said dowel is a split dowel.

5. The cam cover assembly of claim 1, further including a front side and wherein at least one of said front and said back includes at least one reinforcing rib.

6. A cylinder head assembly comprising:
- a cylinder head having an upper surface;
- a cam cover cap plug having an arched top, an underside including a seal-receiving groove, a back, and a pair of spaced apart arms extending therefrom, each of said arms including a fastener for attachment to said cylinder head upper surface; and
- a cam cover having an arched cut-out area for receiving said arched top of said plug.

7. The cylinder head assembly of claim 6, wherein said underside of said cam cover cap plug is flat.

8. The cylinder head assembly of claim 6, wherein each of said fasteners is a dowel integrally formed with said plug.

9. The cylinder head assembly of claim 6, wherein said cam cover cap plug includes a front and wherein at least one of said front and said back includes a recessed area.

10. The cylinder head assembly of claim 9, wherein at least one of said front and said back includes at least one reinforcing rib.

11. A cam cover assembly cap plug comprising:
- a body having a front, a back, an arched top, and an underside;
- a pair of spaced apart arms extending from said back of said body; and
- a fastener for attaching each of said arms for attachment to a cylinder head,
- wherein at least one of said front and said back includes a recessed area.

12. The cam cover assembly of claim 11, wherein said underside is flat and includes a seal-receiving groove.

13. The cam cover assembly of claim 11, wherein said fastener is a mechanical fastener.

14. The cam cover assembly of claim 11, wherein each of said arms includes an integrally-formed fastener extending therefrom.

15. The cam cover assembly of claim 14, wherein said fastener is a dowel.

16. The cam cover assembly of claim 15, wherein said dowel is a split dowel.

17. The cam cover assembly of claim 11, wherein at least one of said front and said back includes at least one reinforcing rib.

18. The cam cover assembly of claim 11, further including a reinforcing bridge formed between said arms.

* * * * *